US005695014A

United States Patent [19]

Jenne

[11] Patent Number: 5,695,014

[45] Date of Patent: Dec. 9, 1997

[54] RAM BORING APPARATUS

[75] Inventor: Dietmar Jenne, Strengelbach, Switzerland

[73] Assignee: Terra AG fuer Tiefbautechnick, Strengelbach, Switzerland

[21] Appl. No.: 526,955

[22] Filed: Sep. 12, 1995

[30] Foreign Application Priority Data

Sep. 20, 1994 [DE] Germany ..... 44 33 533.4

[51] Int. Cl.[6] ..... E21B 4/14; E21B 10/38; E21B 7/04

[52] U.S. Cl. ..... 175/21; 173/63; 173/91; 175/73

[58] Field of Search ..... 173/21, 19, 73, 173/80, 63, 64, 91

[56] References Cited

U.S. PATENT DOCUMENTS

| | | | |
|---|---|---|---|
| 2,046,659 | 7/1936 | Smith, Jr. | 173/65 |
| 2,090,032 | 8/1937 | Curtis | 173/65 |
| 2,572,841 | 10/1951 | Osgood et al. | 173/65 X |
| 3,167,136 | 1/1965 | Cook | 173/80 X |
| 4,858,704 | 8/1989 | McDonald et al. | 175/19 X |
| 4,875,292 | 10/1989 | Gibson | 175/45 X |
| 4,905,773 | 3/1990 | Kinnan | 175/19 |
| 4,907,658 | 3/1990 | Stangl et al. | 175/21 |
| 5,020,608 | 6/1991 | Oden et al. | 175/21 |
| 5,258,755 | 11/1993 | Kuckes | 175/45 X |
| 5,301,758 | 4/1994 | Jenne | 175/21 |

FOREIGN PATENT DOCUMENTS

| | | | |
|---|---|---|---|
| 613098 | 6/1978 | U.S.S.R. | 175/21 |

*Primary Examiner*—Hoang C. Dang
*Attorney, Agent, or Firm*—McCormick, Paulding & Huber

[57] ABSTRACT

A ram boring apparatus has a generally cylindrical body with an attached head, the apparatus being connected to a drive rod which pushes the apparatus forwardly through the earth. The drive rod can also rotate the body and the attached head about the longitudinal axis of the apparatus, and operation of the apparatus can also be supported by the ejection of pressure fluid from one or more jets arranged on the head and by a hammering mechanism carried by a portion of the body. The hammering mechanism is activatable by pressure fluid from the same source as the pressure fluid supplied to the one or more jets. The pressure fluid is delivered through the hollow drive rod and a control valve in a fluid supply line in the body, in dependence on the pressure of the pressure fluid supplied to the apparatus, selectively directs the pressure fluid to the one or more jets in the head or simultaneously to both the one or more jets and to the hammering mechanism. A sender may be included in a portion of the body for the transmission of electromagnetic radiation by means of which the location and angular orientation of the apparatus can be determined from the surface of the earth or other remote location.

5 Claims, 4 Drawing Sheets

RAM BORING APPARATUS

FIELD OF THE INVENTION

The invention concerns a ram boring apparatus with a generally cylindrical body, a head having formed in it at least one jet opening for the ejection of a stream of high pressure fluid and a hammering mechanism arranged in the body and driven by a pressure medium for driving the apparatus forwardly.

BACKGROUND OF THE INVENTION

A ram boring apparatus of the aforementioned character is known, for example, from U.S. Pat. No. 4,858,703. In the apparatus described by that patent the hammering mechanism is driven by air pressure. The fluid required for the high pressure stream is delivered by a line to an expansion chamber in the housing and is driven out of the expansion chamber by means of air pressure.

In the prior art, approaches are also known in which the hammering mechanism is driven by air pressure, while separate therefrom high pressure fluid is delivered to the jet.

Common to all known approaches is the disadvantage that two kinds of pressure medium have to be supplied. Therefore, at least two pressure fluid sources are required and the construction of the ram boring apparatus is correspondingly complicated. Moreover, several pressure fluid lines have to be provided which in practice represent a large source of operational problems. With high pressure, these conductors have to be made with strong walls and they are, therefore, inflexible, heavy and a hindrance to practical operation.

The invention has as its object the provision of a ram boring apparatus of the aforementioned kind which is simple and economical in construction and easy to handle.

This object is solved in accordance with the invention in that the hammering mechanism is formed as an hydraulic hammering mechanism and it and the jet opening are connectable with the same pressure fluid source.

Therefore, only one pressure fluid source is required for the ram boring apparatus of the invention, which source can, for example, be water, a water-polymer-mixture or Bentonite under high pressure delivered to the ram boring apparatus. Thereby a single pressure fluid conductor to the ram boring apparatus is sufficient. The ram boring apparatus can accordingly be simply constructed and is easy to handle, since it need be connected by only a single pressure fluid conductor with the stationary station.

If the body is connected with a forward drive rod, a control valve can be arranged in the pressure fluid line in the body upstream of the hammering mechanism and/or the jet opening for selectively delivering the pressure fluid to the hammering mechanism and/or to the jet opening. This offers the possibility that, in accordance with the workability of the earth encountered by the ram boring apparatus, the ram boring apparatus can be driven forwardly with or without the use of the hammering mechanism. For example, the control valve can be so made that it is controllable in dependence on the pressure of the pressure fluid. For example, the arrangement can be that with fluid pressures up to 80–100 bar the hammering mechanism does not operate, with the pressure fluid only being ejected in known way forwardly out of the one or more flushing jets of the boring head to break up the earth. If the operator adjusts the pressure of the pressure fluid to a value above 80–100 bar, the control valve opens to deliver the fluid to the hammering mechanism, so that this mechanism begins to operate. In this way the ram boring apparatus is actively driven through gravelly earth. While the hammering mechanism operates, at the same time flushing fluid is ejected in known way forwardly from the boring head for loosening the earth.

Preferably the head, along with the body, is rotatable about its longitudinal axis by means of the forward drive rod and has a control surface oriented at an angle other than 90° to the body longitudinal axis. For improving the boring efficiency, at least the control surface can be studded with hard metal bodies. For straight bores, the ram boring apparatus is rotated at, for example, 100–200 revolutions per minute. For the control of the ram boring apparatus and a change in the direction of the boring, the ram boring apparatus is held in a given position of the head and the apparatus is then moved forwardly, percussively or statically, without rotation, so that through the control surface on the head it is deflected in the desired direction. This process is assisted by the fluid which is ejected from the one or more jet openings.

The head can also be symmetrical with respect to the longitudinal axis of the body. Such a head can better destroy obstacles than the asymmetrical head with control surface. Its control characteristics are, however, not as good as those of the asymmetrical head since the control effect in its case can only be achieved by asymmetrical arrangement of the jet openings.

The head can be axially rigidly or movably connected with the body. Practically, the head is exchangeable with the body, so that in accordance with the type of earth at hand different forms of heads can be put into use.

For locating the ram boring apparatus in the earth, the apparatus can also contain in a known way a sender for transmitting electromagnetic radiation by the help of which the position of the apparatus can be determined and from which also the measurement of the ram boring apparatus to the upper earth surface can be determined. Practically the sender is impact dampeningly arranged in a sender housing positioned behind—with respect to the forward drive direction—the hammering mechanism in order to better protect it against damage.

For manufacturing and maintenance reasons, the body can be divided into a hammering mechanism containing portion and a sender receiving portion.

In a preferred embodiment of the invention, the outer diameter of the ram boring apparatus decreases from front to rear. This on one hand eases the control of the apparatus and on the other hand eases the carrying away toward the rear of the bored out or washed out material by the flushing fluid. Practically, the outer diameter of the body portion containing the hammering mechanism is smaller than the outer diameter of the head and the outer diameter of the body portion receiving the sender is smaller than the outer diameter of the body portion receiving the hammering mechanism.

In order to be able to use water as the pressure fluid without danger of corrosion, it is practical if at least the portions of the ram boring device which come into contact with the pressure fluid are made of a corrosion resistant material, especially stainless steel.

Further features and advantages of the invention will be apparent from the following description, which in connection with the accompanying drawings explain the invention by way of exemplary embodiments.

DESCRIPTION OF THE PREFERRED EMBODIMENTS

Figure 1:
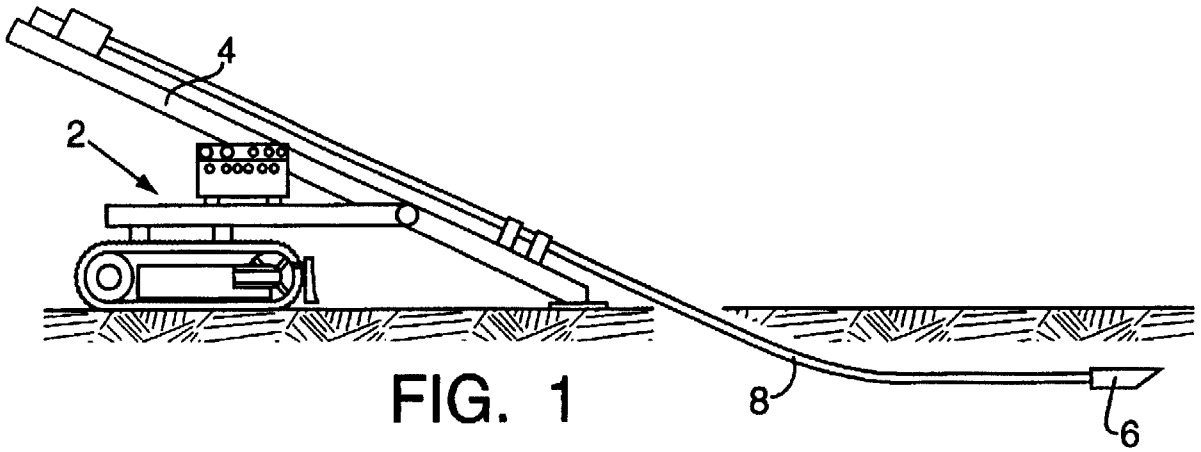
FIG. 1—A schematic illustration of a boring system using a ram boring apparatus embodying the invention.

FIG. 1 shows a boring wagon 2 with a ramp 4 for driving forwardly, rotating and controlling a ram boring apparatus 6, by means of a boring rod 8. The boring wagon includes a non-illustrated source of pressure fluid.

Figure 2:
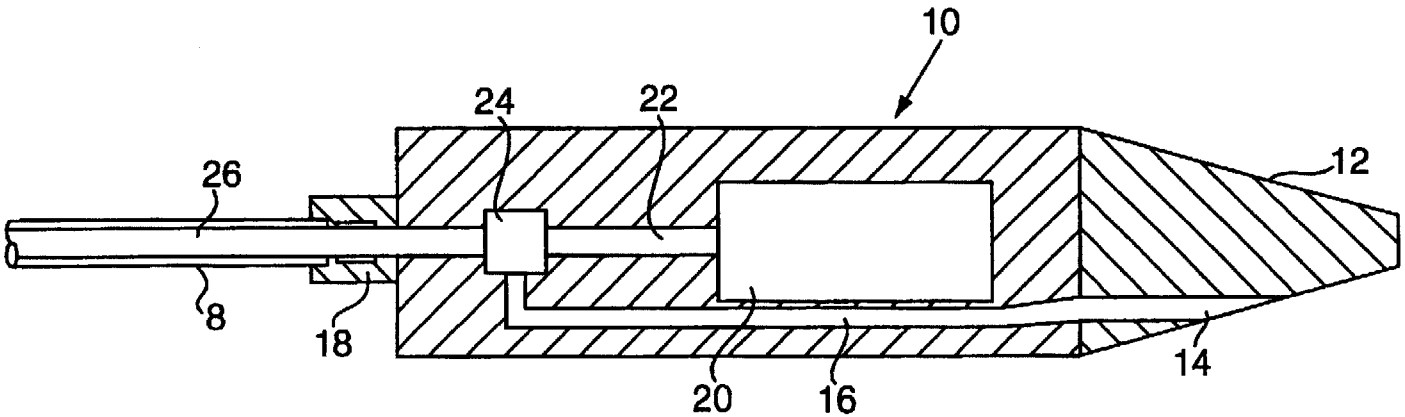
FIG. 2—A schematic longitudinal section through a ram boring apparatus embodying the invention and having a symmetrical head.

The ram boring apparatus 6 illustrated in FIG. 2 includes a cylindrical body 10 on the forward end of which is arranged a boring head 12 symmetrical with respect to the longitudinal axis of the body. The boring head 12 has at least one jet opening 14 which through a canal 16 and a control valve 24 stands in connection with a pressure fluid connector 18 at the rear end of the body or housing 10.

Inside of the body 10 is a hammering mechanism, indicated only schematically at 20, which can drive the body 10 together with the head 12 automatically through ground of given composition. The hammering mechanism 20 is connected with the pressure fluid connector 18 through a conductor 22 and the control valve 24. The control valve 24 is controllable in such a way in dependence on the pressure that selectively either the jet opening 14 only is, or the jet opening 14 and the hammering mechanism 20 are, connected with the pressure fluid source.

At its rear end, the housing 10 is connected with the hollow forward drive or boring rod 8, through which the ram boring apparatus can be driven statically forwardly and rotated by the boring wagon 2.

Through the pressure fluid connector 18 and a pressure fluid conductor 26, connected with the pressure fluid connector 18 and carried inside the hollow boring rod 8, a pressure fluid, for example water, a water-polymer mixture or another known boring fluid is delivered. If the pressure of this fluid lies below a pre-given threshold value, for example 80–100 bar, the control valve 24 closes the conductor 22, and the pressure fluid discharges from the jet opening 14 in order to break up or wash away the region of earth lying in front of the head 12.

If the composition of the earth is such that static forward drive of the ram boring device by means of the forward drive rod 8 is no longer possible, the pressure of the pressure fluid is increased to a value above the threshold value so that the control valve 24 opens and the pressure fluid drives the hammering mechanism 20. In this way, the ram boring apparatus can also, for example, be forwardly driven through gritty or stony earth or individual hindrances can be disintegrated.

The threshold value at which the control valve 24 again closes the conductor 22 and thereby interrupts the drive of the hammering mechanism 20 should lie distinctly below the threshold value for the switching on of the hammering mechanism 20 in order to avoid a fluttering of the control valve. At the moment the hammering mechanism is turned on, the pressure fluid pressure decreases suddenly because of the increased requirement for pressure fluid. If the two threshold values for the turning on and turning off of the hammering mechanism are not different from one another or are only slightly different from one another, a constant turning on and turning off of the hammering mechanism would be unavoidable.

The directional control of the ram boring apparatus according to FIG. 2 takes place in the way, that the ram boring apparatus is held in a definite rotational position so that the unsymmetrically arranged jet softens the earth to the side of the ram boring apparatus, toward which the ram boring apparatus is to be deflected. If the ram boring apparatus is thereafter driven forwardly with the help of the boring rod or the hammering mechanism, it will be deflected into the softened region of the earth. Then for a straight run the ram boring apparatus can again be rotated by means of the boring rod.

Figure 3:
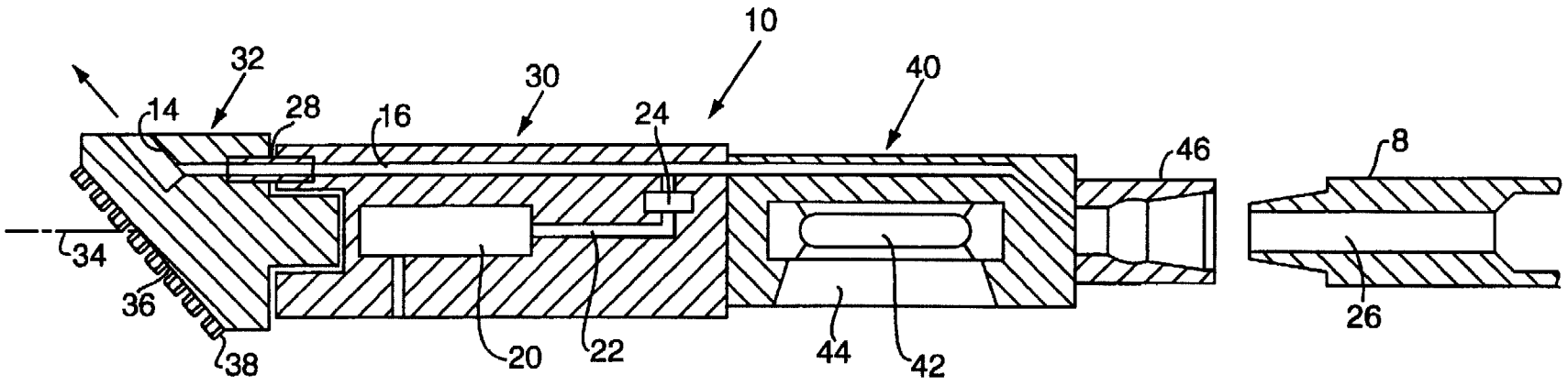
FIG. 3—A schematic longitudinal section through a ram boring apparatus comprising a second embodiment of the invention and having asymmetrical head.

In the embodiment illustrated in FIG. 3, the body 10 includes a first section 30, in which the hammering mechanism 20 and the control valve 24 are located. An asymmetrical control head 32 is exchangeably arranged on the forward end of the body section 30. The control head 32 has a control surface 36, oriented at an inclination to the axis 34 of the housing and studded with hard metal bodies 38. The control head 32 and body 10 can, by means of the boring rod 8, be rotated about the body axis 34 or can be held in a desired position relative to the body axis. The control head 32 further has a jet opening 14, which so opens away from the side, that the ejected jet stream is directed forwardly at an inclination to the body axis 34.

Figure 4:
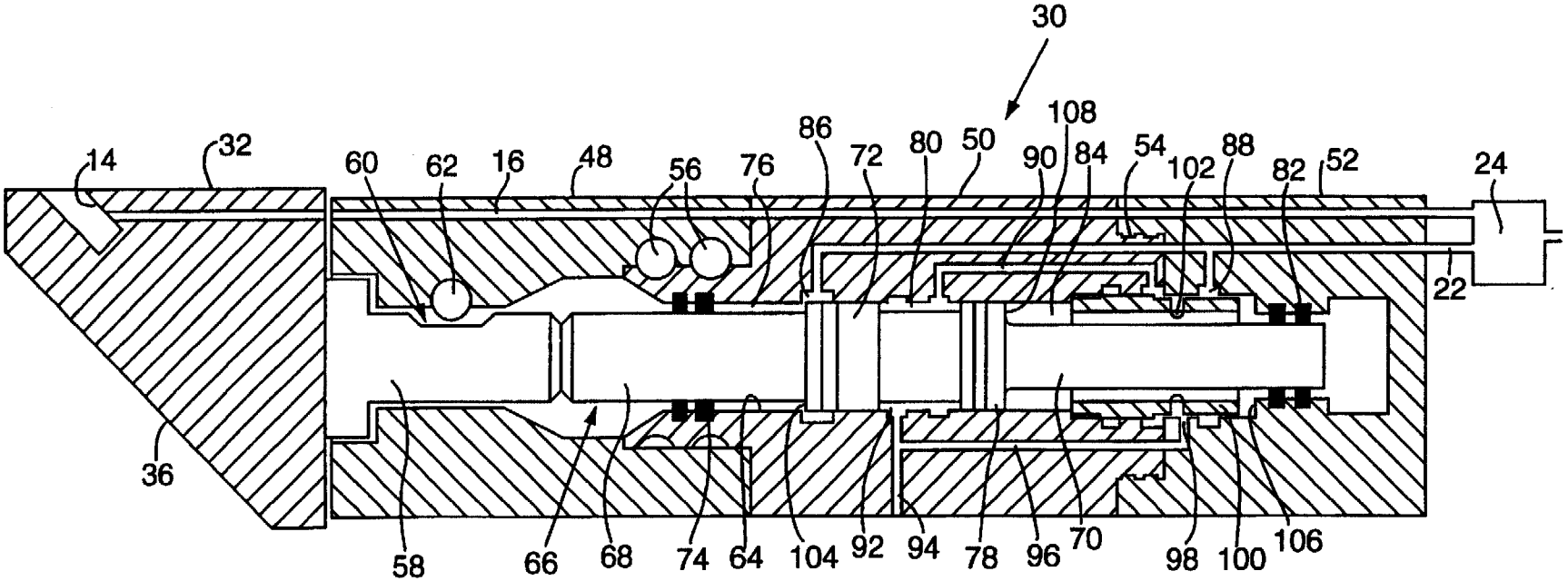
FIG. 4—A fragmentary sectional view corresponding to FIG. 3 taken through the ram boring apparatus with a partially schematic illustration of the hammering mechanism with its hammering piston in its forward position.
Figure 5:
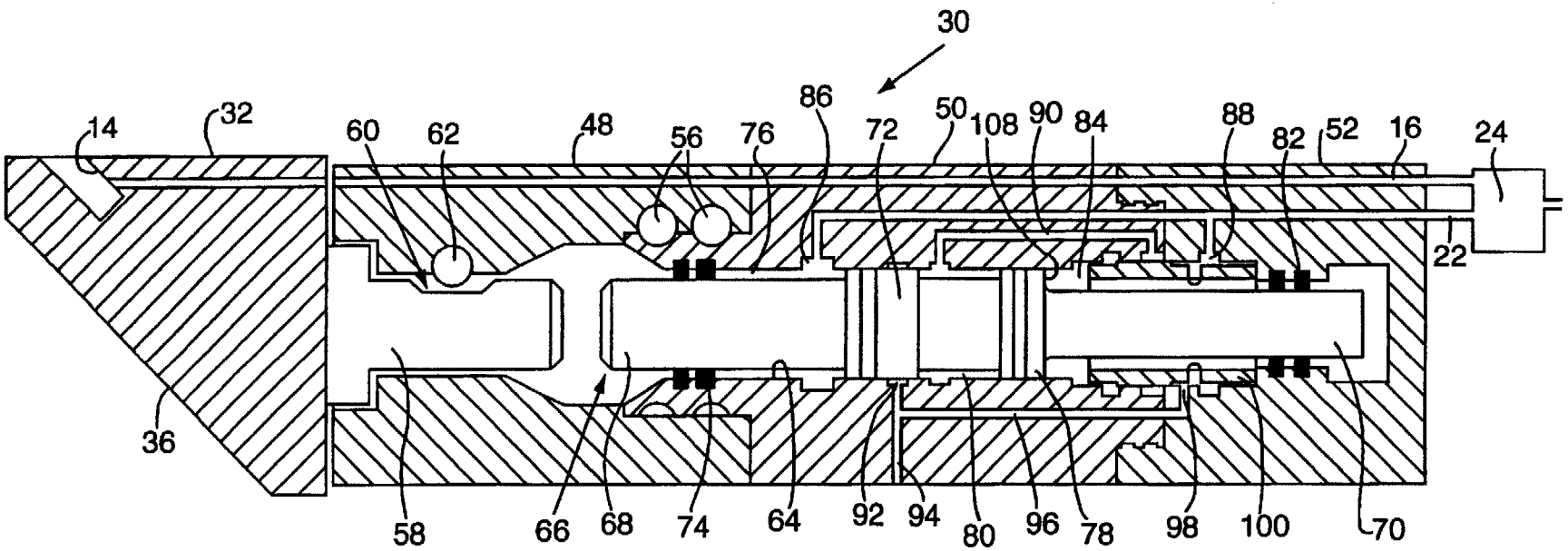
FIG. 5—A view corresponding to FIG. 4 but with the hammering piston in its rearward position.

At the connection point between the body section 30 and the control head 32 a coupling 28 is provided for the connection of the fluid conductor 16 of the section 30, which coupling 28 permits an axial movement of the control head 32 relative to the body 10, as explained further in connection with FIGS. 4 and 5.

Connected to the rear end of the body section 30 is a sender housing 40 in which a sender 42 is supported so as to be damped against impact. The sender 42 sends electromagnetic radiation outwardly through slits 44 provided in the sender housing 40 so that with the help of that radiation the position of the ram boring apparatus can be determined by a suitable receiver on the upper surface of the earth. The sender 42 also serves to indicate the position of the control surface 36 in space so that a control of the ram boring apparatus can be practically effected.

At the rear end of the housing section formed by the sender housing 40 is a connecting part 46 for the hollow pushing rod 8, through which the pressure fluid delivery occurs.

As can be seen, the outer diameter of the cylindrical body section 30 is somewhat smaller than the outer diameter of the control head 32. The outer diameter of the sender housing 40 is in turn somewhat smaller than the outer diameter of the body section 30.

The hammering mechanism will now be explained in more detail in connection with FIGS. 4 and 5. These figures show the control head 32 and the body section 30 of the embodiment illustrated in FIG. 3. Similar parts are given the same reference numbers. The body section 30 consists of three body portions 48, 50, 52. The body portions 50 and 52 are threadably connected with one another at 54. The two portions 50 and 48 are plugged together and secured by bolts 56. The control head 32 has a pin 58 inserted into the forward end of the body portion 48. The pin 58 has a groove 60 in its circumferential surface which receives a bolt 62 extending through the body portion 48. As will be seen from FIGS. 4 and 5, the control head 32 is thereby held to the body portion 48 so as to be non-rotatable but axially movable relative to the body portion 48.

A percussive piston 66 is axially slideably supported in an axial bore, indicated generally at 64, in the housing section 30. It includes a larger diameter forward shaft 68 and a smaller diameter rear shaft 70. A first forward piston portion 72 and forward seals 74 limit in the axial direction a forward chamber 76 of the bore 64. A second rear piston portion 78, axially spaced from the first piston portion 72, together with the first piston portion 72, limits in the axial direction a middle chamber 80 of the bore 64. The rear piston portion 78, together with rear seals 82, limit in the axial direction a rear chamber 84 of the bore 64.

The pressure line 22 for the delivery of pressure fluid to the hammering mechanism 20 connects the control valve 24 with an inlet opening 86 in the forward chamber and an inlet opening 88 in the rear chamber. The rear chamber and the middle chamber are connected to one another by a control line 90. The middle chamber 80 is further connected with an outlet 94 for the pressure fluid by a discharge opening 92. The outlet 94 is further connected with a discharge opening 98 for the rear chamber 84 by a line 96.

The rear shaft 70 is surrounded with radial spacing by a control sleeve 100 having a plurality of radial bores 102.

FIG. 4 shows the percussive piston in its forwardmost position, at which it impacts on the pin 58 of the control head 32, the axial movement of the control head having not been taken into consideration in the illustration. The axial movability of the control head 32 makes possible a better utilization of the kinetic energy of the percussive piston 66. In this position the control sleeve 100 is also in its forward end position. The middle chamber 80 is connected with the outlet 94. The delivery of pressure fluid through the inlet opening 88 is blocked by the control sleeve 100. The inlet opening 86 in the first chamber is, on the other hand, only partially blocked by the forward piston portion 72, so that pressure fluid can work on the annular forwardly facing surface 104 of the piston portion 72. Since the middle chamber 80 and the rear chamber 84 are connected with the non-pressurized outlet 94, and the inlet opening for the pressure fluid in the rear chamber 84 is blocked by the control sleeve 100, the percussive piston 66 will be moved rightwardly from the position illustrated in the figure, that is toward the rear. As soon as the piston portion 72 is driven past the outlet opening 92 of the middle chamber 80, pressure fluid can no longer escape from the middle chamber. The dimensioning of the surfaces of the control sleeve 100 on which the pressure fluid is effective is so chosen that lastly under the conditions of FIG. 4 it is likewise moved to the right or rearwardly, until it abuts a shoulder 106 of the housing section 52. In this position, the inlet opening 88 for the entry of pressure fluid to the rear chamber 84 is unblocked. This position of the hammering mechanism is illustrated in FIG. 5. The pressure of the entering pressure fluid works on the rearwardly facing annular surface 108 of the piston portion 78, which is larger than the annular surface 104 of the piston portion 72. Thereby the percussive piston 66 is not only braked but is also again driven toward the left from the end position illustrated in FIG. 5, that is, moved forwardly until the piston impacts onto the pin 58 of the control head 32. Thereby the piston portion 72 frees the outlet opening 92 of the middle chamber 80 so that the pressure in this chamber can fall off. The reduction of pressure in the middle chamber 80 has the effect, through the control line 90, that now the pressure in the rear chamber 84 moves the control sleeve 100 toward the left, that is forwardly, until it reaches the position illustrated in FIG. 4, in which the inlet opening 88 for pressure fluid to the rear chamber 84 is again closed. The described cycle then begins anew.

The apparatus of FIGS. 3 and 5 as so far described operates in the following ways:

The pressure of the flushing liquid can be adjusted from the boring wagon 2 arranged on the surface of the earth or in a starting excavation. With a flushing liquid pressure up to about 100 bar the control valve 24 remains closed so that the hammering mechanism is not operated. In this case the apparatus works only as a boring apparatus. To bore straight ahead, the ram boring apparatus, that is the head 32 and body 10, is rotated at about 100 to 200 revolutions per minute and at the same time is pushed forwardly by the non-illustrated rod 8. The flushing liquid which is discharged by the jet directed forwardly or toward the side breaks up the earth and thereby makes easier the boring operation. In special soils, such as sandy soils, it is necessary that the earth be carried away rearwardly along the rod. This is accomplished by the escaping flushing fluid. Practically for this fluid a polymer-water-mixture or Bentonite is, for example, used. In order to control the boring direction and thereby change the direction of the bore, the boring head is brought to a suitable rotational position, with information as to the actual rotational position being supplied by the sender 42. Thereafter the boring apparatus is pushed forwardly with the boring head 32 non-rotating. The control surface 36 inclined to the body axis 34 effects a deflection of the boring apparatus in the desired direction. This procedure is also supported by the flushing liquid which is discharged by the jet 14. This is especially the case when the jet is directed sidewise, since then the earth is broken up in the direction in which the boring apparatus is to be deflected.

In the case of densely compacted gravel or stony sub-soil, the previously described way of operating is no longer possible. In such ground, the boring apparatus can be driven forwardly only by means of the hammering mechanism 20. To switch on the hammering mechanism, the flushing liquid pressure is adjusted to 150 to 200 bar. Since the control valve 24 opens at a flushing liquid pressure of about 100 bar, the hammering mechanism 20 begins to hammer. The flushing liquid now flows through the channel 16 to the one or more jets 14 as well as through the line 22 to the hammering mechanism 20 so as to drive the hammering mechanism. The flushing fluid flows from the hammering mechanism 20 at close to zero pressure laterally through the bore 64 in the body section 30. This flow is eased by the somewhat smaller outside diameter of the body section 30. The discharged boring fluid thereby takes with it the bored out material. By the smaller diameter of the body sections 30 and 40 with respect to the head 32, the control capability of the ram boring apparatus is increased. The hammering mechanism 20 supports also the forward drive of the ram boring apparatus during straight runs and during curved runs in gravelly and stony earths in which purely static forward drive supported by flushing fluid is no longer sufficient.

I claim:

1. A ram boring apparatus adapted for connection to a pressure fluid line (26) supplying a pressure fluid, and having a generally cylindrical body (10) with a longitudinal axis, a head (12,32) extending along said longitudinal axis in which head a plurality of jet openings (14) are formed for the ejection of streams of said pressure fluid, and a pressure fluid driven hammering mechanism (20) arranged in the body (10) for forward drive of the ram boring apparatus, characterized in that the hammering mechanism (20) is formed as a hydraulic hammering mechanism, in that the hammering mechanism (20) and the jet openings (14) are each connectable directly with said pressure fluid line so that pressure fluid from said line can flow to said jet openings without passing through said hammering mechanism, in that the body (10) is connected with a forward drive rod (8), in that the head (12,32) together with the body (10) is rotatable about its longitudinal axis (34) by means of the rod (8), in that the head (12) is formed symmetrically with respect to said longitudinal axis (34) of said body, and in that said jet openings of the head are arranged unsymmetrically with respect to said longitudinal axis (34).

2. A ram boring apparatus according to claim 1 further characterized in that the head (12, 32) is axially rigidly connected with the body (10).

3. A ram boring apparatus according to claim 1 further characterized in that the head (12, 32) is axially movably connected with the body (10).

4. A ram boring apparatus adapted for connection to a pressure fluid line (26) supplying a pressure fluid, and having a generally cylindrical body (10) with a longitudinal axis, a head (12,32) extending along said longitudinal axis in which head at least one jet opening (14) is formed for the ejection of a stream of said pressure fluid, and a pressure fluid driven hammering mechanism (20) arranged in the body (10) for forward drive of the ram boring apparatus, characterized in that the hammering mechanism (20) is formed as an hydraulic hammering mechanism and that the hammering mechanism (20) and the jet opening (14) are each connectable directly with said pressure fluid line so that pressure fluid from said line can flow to said jet opening without passing through said hammering mechanism, in that the body (10) is connected with a forward drive rod (8), and in that the head (12,32) together with the body (10) is rotatable about its longitudinal axis (34) by means of the rod (8), in that the head (32) has a control surface (36) oriented at an angle other than 90° to the body axis (34).

5. A ram boring apparatus according to claim 4 further characterized in that at least the control surface is studded with hard metal bodies (38).

* * * * *